US005611618A

United States Patent [19]

Sawyer

[11] Patent Number: 5,611,618

[45] Date of Patent: Mar. 18, 1997

[54] SUSPENDED ORNAMENT FOR LAMP FINIAL

[76] Inventor: Gerald F. Sawyer, 2826 Tree Top Rd., Dacula, Ga. 30211

[21] Appl. No.: 431,533

[22] Filed: Apr. 28, 1995

[51] Int. Cl.[6] ..... F21V 17/00

[52] U.S. Cl. ..... 362/417; 362/351; 362/806; 40/554; 248/302; 428/16

[58] Field of Search ..... 40/412, 554, 617; 428/16, 28; 446/210; 362/351, 358, 412, 417, 806; 248/205.1, 302–304, 339–341

[56] References Cited

U.S. PATENT DOCUMENTS

| | | | |
|---|---|---|---|
| 442,629 | 12/1890 | Lipscomb | 40/617 |
| 1,559,327 | 10/1925 | Kayashima et al. | 446/210 |
| 1,676,422 | 7/1928 | Best | 428/28 |
| 1,728,166 | 9/1929 | Horton | 446/210 |
| 2,010,004 | 8/1935 | Berggren | 362/255 |
| 2,092,520 | 9/1937 | Nielsen | 40/412 |
| 2,608,645 | 8/1952 | Hines | 362/806 |
| 2,823,477 | 2/1958 | Willard | 40/554 |
| 3,290,817 | 12/1966 | Kravath | 428/16 |
| 3,595,727 | 7/1971 | Allen | 428/16 |
| 4,851,981 | 7/1989 | Ruesch | 362/417 |

*Primary Examiner*—Alan Cariaso
*Attorney, Agent, or Firm*—James B. Middleton

[57] ABSTRACT

A finial for a lamp shade has a conventional finial base to screw onto the stud of a harp. A bail extends upwardly from the base and supports a hook from which an ornament can be suspended. An ornament having a chain thereon can be hung from the hook, or an adapter can be used to suspend a conventional finial. The conventional finial base has a central hole, and the bail is received within the hole and glued or otherwise fixed in place. The bail can be sized so the finial can be used on a lamp shade having downwardly extending wires, the ornament being supported above the lamp shade so the ornament appears to float above the shade.

10 Claims, 1 Drawing Sheet

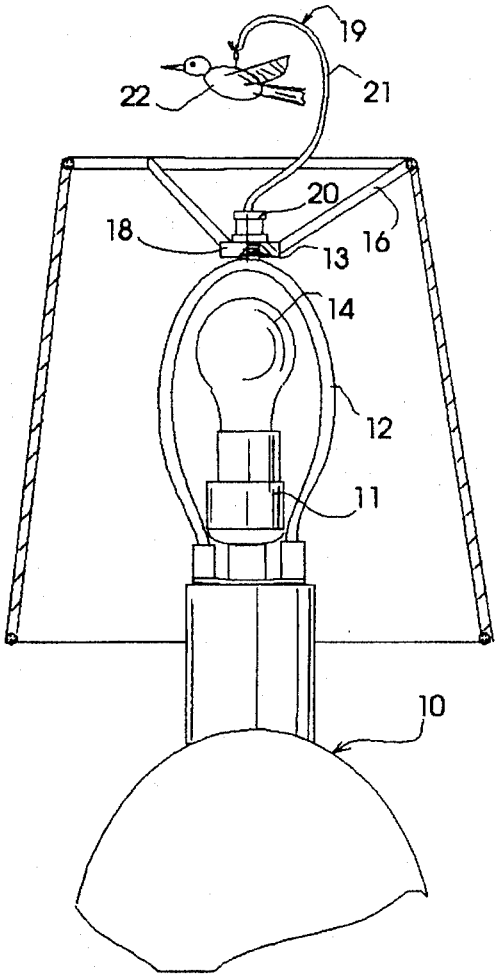
Fig. 1
Fig. 2
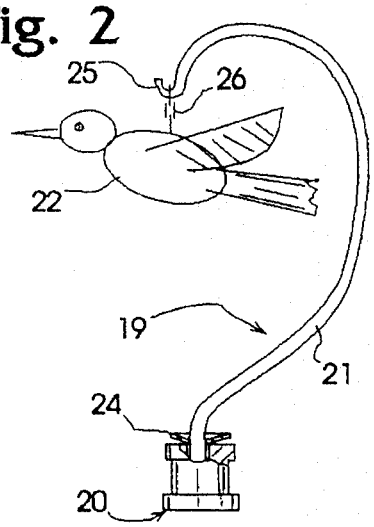
Fig. 3
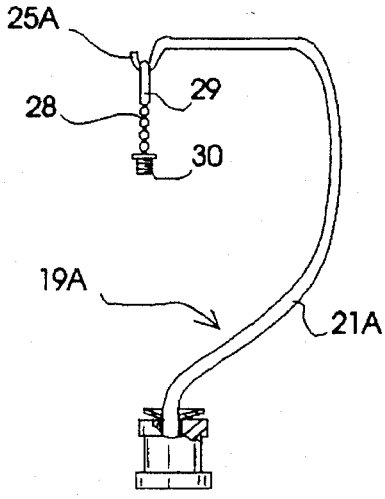

SUSPENDED ORNAMENT FOR LAMP FINIAL

BACKGROUND OF THE INVENTION

1. Field of the Invention

This invention relates generally to finials for lamp shades, and is more particularly concerned with a finial having a suspended ornament.

2. Discussion of the Prior Art

It is well known in the art to mount a harp on a lamp, the harp supporting a lamp shade. To secure the shade to the harp, the harp is typically provided with a threaded stud, and a finial is threadedly engaged with the stud, both to hold the shade in position and to provide an ornament at the top of the shade.

One conventional form of lamp shade includes a plurality of radially extending wires generally at the top of the shade, the wires supporting a washer centrally of the shade. The wires usually extend substantially horizontally, so the finial is at the top of the shade, and the ornament is easily visible. In some shades, however, the radially extending wires are directed downwardly, below the horizontal, so the centrally placed washer is below the upper end of the shade. With such shades, one generally uses only a cap nut or the like to secure the shade in place. The use of an ornamental finial tends to be of no value because the ornament would be obscured by the shade.

If one insist on a decorative finial, one might use one or more "shade lifters" fixed to the stud on the harp, the shade lifters then receiving an ornamental finial. The long extension of the shade lifters, however, tends to be somewhat visible, and the finial is not particularly stable. Thus, there is no truly satisfactory system for adding an ornamental finial to the lamp shade having downwardly extending wires.

SUMMARY OF THE INVENTION

The present invention provides a threaded finial base having a bail mounted thereon. The bail extends upwardly and terminates in mounting means from which an ornament can be suspended. The bail is preferably so shaped as to place the ornament generally above the finial base. For use on a lamp shade having downwardly extending wired, it is contemplated that the bail will be long enough to dispose the ornament suspended from the mounting means above the lamp shade, to be easily visible. The ornament may therefore appear to be floating above the lamp shade. Obviously, the bail can be made any desired length to place the ornament as desired.

Those skilled in the art will also understand that the finial of the present invention can be used on a lamp shade having horizontally extending wires. For such shades, the bail may be shorter since the bail will begin above the lamp shade rather than below it.

BRIEF DESCRIPTION OF THE DRAWINGS

These and other features and advantages of the present invention will become apparent from consideration of the following specification when taken in conjunction with the accompanying drawings in which:

FIG. 1 is a diametrical cross-sectional view through a lamp shade having downwardly extending wires, with a finial made in accordance with the present invention mounted thereon;

FIG. 2 is an enlarged elevational view showing the finial illustrated in FIG. 1; and, FIG. 3 is a view similar to FIG. 2, but showing a modified form of finial.

DETAILED DESCRIPTION OF THE EMBODIMENTS

Referring now more particularly to the drawings, and to those embodiments of the invention here presented, FIG. 1 shows a lamp 10 partially broken away, the lamp 10 including a light socket 11 with a harp 12 extending over the socket 11, and a light bulb 14. Those skilled in the art will understand that the harp 12 includes a threaded stud 13 at the apex thereof.

The lamp shade 15 illustrated in FIG. 1 includes downwardly extending, radial wires 16. It will be recognized that lamp shades generally have wires 16 extending horizontally. Some lamp manufacturers, however, purchase only one size of harp 12, and use the same harp on all lamps. To accommodate the various sizes of lamps and various sizes of shades, the wires 16 are angled. For small lamps, the wires 16 may be angled only slightly, so the central washer 18 is only an inch or less below the top of the lamp shade 15; for large lamps, the wires 16 may be severely angled so that the washer 18 is as much as six inches below the top of the lamp shade.

Looking at FIG. 1 of the drawings, it will be understood that, if a conventional ornamental finial were used to hold the washer 18, hence the shade 15, in place, the ornament would be almost entirely obscured by the shade 15. As a result, one generally uses simply a cap nut threaded onto the stud 13 to hold the washer 18 in place.

The present invention provides a finial generally designated at 19, the finial 19 including a conventional finial base 20 which mounts a bail 21. The bail 21, then, suspends an ornament 22. It will be seen that the bail 21 is long enough that the ornament 22 is held above the lamp shade 15, so the usual advantages of a lamp finial are realized.

FIG. 2 illustrates the finial 19 shown in FIG. 1 in more detail. Here it can be seen that the conventional finial base 10 includes a mounting plate 24 that is rotatable with respect to the base 20. The mounting plate 24 defines an opening centrally thereof for receiving a screw or the like to mount the conventional ornament. In the finial of the present invention, one end of the bail 21 is received within the central opening. The bail 21 can be glued, soldered or otherwise fixed to the base 20. In one embodiment of the invention, the bail has been fixed to the mounting plate 24 with an epoxy cement.

As shown in FIG. 2, the bail 21 is shaped similarly to a question mark. This shape provides for the center support of the bail 21, provides space for the ornament 22 to occupy, and terminates in a supporting means generally above the center mount. While many mechanical expedients can be found as the supporting means, a simple hook is here illustrated. The hook 25 receives a chain 26 which carries the ornament 22.

Looking next at FIG. 3 of the drawings, it will be noticed that the finial, designated at 19A, is very similar to the finial 19, but is slightly modified.

The shape of the bail 21A is slightly modified to emphasize the fact that the bail can be variously shaped. Though here shown as generally question-mark-shaped, the bail may be elliptical, rectangular, polygonal or other shapes. Further, instead of the single wire here shown, the bail may have two supporting sides with the supporting means at the apex.

The embodiment of the invention shown in FIG. 3 includes a hook 25A as a supporting means; but, instead of the chain fixed to an ornament, the bead chain 28 has a loop 29 to be received on the hook 25A. The chain 28, then, carries an adapter 30 for receiving a conventional finial. As a result, any commercially available finial can be used as an ornament for the finial of the present invention. The adapter 30 is disclosed and claimed in U.S. Pat. No. 5,339,618, and the disclosure of that patent is incorporated herein by this reference.

It will therefore be understood that the finial of the present invention provides a finial usable with lamp shades having downwardly directed wires. The finial includes a base receivable on the harp within the lamp shade, and a bail having supporting means for supporting an ornament above the top of the lamp shade. It will be understood that the bail can be any height, or length, desired, so the finial of the present invention can be adapted to any lamp shade, regardless of the distance of the center washer below the top of the lamp shade. The finial can utilize an ornament having a chain or the like attachable to the supporting means, or an adapter may be used for utilizing any conventional lamp shade finial as an ornament.

It will of course be understood by those skilled in the art that the particular embodiments of the invention here presented are by way of illustration only, and are meant to be in no way restrictive; therefore, numerous changes and modifications may be made, and the full use of equivalents resorted to, without departing from the spirit or scope of the invention as outlined in the appended claims.

I claim:

1. A finial, for a lamp shade having a washer centrally thereof for supporting the lamp shade, the washer being received on a stud extending from a harp for a lamp, said finial comprising a finial base threadedly receivable on said stud for holding said washer to said harp, a bail carried by said finial base and extending upwardly from said finial base, said bail including supporting means disposed substantially above said finial base, and an ornament suspended from said supporting means, said ornament being disposed between said finial base and said supporting means.

2. A finial as claimed in claim 1, said supporting means comprising a hook.

3. A finial, for a lamp shade having a washer centrally thereof for supporting the lamp shade, the washer being received on a stud extending from a harp for a lamp, said finial comprising a finial base threadedly receivable on said stud for holding said washer to said harp, a bail carried by said finial base and extending upwardly from said finial base, said bail including supporting means, and an ornament suspended from said supporting means, wherein said bail is question-mark-shaped, said finial base defining a central opening, and said bail is received within said central opening.

4. A finial as claimed in claim 1, and further including an adapter carried by said supporting means, said adapter including a threaded member for receiving a lamp shade finial, said lamp shade finial constituting said ornament.

5. A finial as claimed in claim 1, wherein said bail is question-mark-shaped, said finial base defining a central opening, said bail being received within said central opening, said supporting means comprising a hook disposed substantially above said finial base.

6. In combination, a lamp having a harp for supporting a shade, a stud extending from said harp, said shade including a plurality of radially extending wires fixed to a central washer, said washer being received over said stud, and a finial, said finial comprising a finial base threadedly received on said stud for holding said washer to said harp, a bail carried by said finial base and extending upwardly from said finial base, said bail including supporting means disposed substantially above said finial base, and an ornament suspended from said supporting means, said ornament being disposed between said finial base and said supporting means.

7. The combination claimed in claim 6, wherein said radially extending wires extend downwardly from the top of said shade so that said washer is below the top of the shade, said bail having sufficient length to dispose said ornament above said shade.

8. The combination claimed in claim 6, said supporting means comprising a hook disposed substantially above said finial base.

9. The combination claimed in claim 6, wherein said bail is question-mark-shaped, said finial base defining a central opening, and said bail is received within said central opening.

10. The combination claimed in claim 6, and further including an adapter carried by said supporting means, said adapter including a threaded member for receiving a lamp shade finial said lamp shade finial constituting said ornament.

* * * * *